US007425142B1

(12) United States Patent
Putz

(10) Patent No.: US 7,425,142 B1
(45) Date of Patent: Sep. 16, 2008

(54) ELECTRICAL CONNECTOR FOR AN IN-BODY MULTI-CONTACT MEDICAL ELECTRODE DEVICE

(75) Inventor: David A. Putz, Pewaukee, WI (US)

(73) Assignee: Ad-Tech Medical Instrument Corp., Racine, WI (US)

( * ) Notice: Subject to any disclaimer, the term of this patent is extended or adjusted under 35 U.S.C. 154(b) by 0 days.

(21) Appl. No.: 11/687,348

(22) Filed: Mar. 16, 2007

(51) Int. Cl.
*H01R 13/44* (2006.01)

(52) U.S. Cl. ..... 439/138; 439/909; 600/378

(58) Field of Classification Search ..... 439/79, 439/909, 885, 138, 142, 144, 798, 824, 482; 607/37–38, 115, 116, 119, 122; 600/373–381
See application file for complete search history.

(56) References Cited

U.S. PATENT DOCUMENTS

| | | | | |
|---|---|---|---|---|
| 4,379,462 | A | 4/1983 | Borkan et al. | |
| 4,461,304 | A | 7/1984 | Kuperstein | |
| 4,516,820 | A | 5/1985 | Kuzma | |
| 4,633,889 | A | 1/1987 | Talalla et al. | |
| 4,676,258 | A | 6/1987 | Inokuchi et al. | |
| 4,712,557 | A | 12/1987 | Harris | |
| 4,735,208 | A | 4/1988 | Wyler et al. | |
| 4,744,371 | A | 5/1988 | Harris | |
| 4,850,359 | A | 7/1989 | Putz | |
| 4,869,255 | A | 9/1989 | Putz | |
| 4,904,213 | A * | 2/1990 | Hock et al. | 439/824 |
| 5,097,835 | A | 3/1992 | Putz | |
| 5,560,358 | A | 10/1996 | Arnold et al. | |
| 5,902,236 | A | 5/1999 | Iversen | |
| 6,415,168 | B1 | 7/2002 | Putz | |
| 6,464,511 | B1 * | 10/2002 | Watanabe et al. | 439/66 |
| 6,671,534 | B2 | 12/2003 | Putz | |
| 6,725,096 | B2 * | 4/2004 | Chinn et al. | 607/115 |
| 6,776,668 | B1 * | 8/2004 | Scyoc et al. | 439/700 |
| 7,134,919 | B2 | 11/2006 | Putz | |

* cited by examiner

*Primary Examiner*—Edwin A. León
(74) *Attorney, Agent, or Firm*—Jansson Shupe & Munger Ltd.

(57) ABSTRACT

An improved electrical connector for connecting a multi-contact medical electrode device with a plural-contact tail. Having a tail-receiving first elongate member with a tail-receiving void and a second elongate member. The second elongate member has a nesting surface and an array of electrical conductors which are spring-loaded pin plunger devices. The spring-loaded pin plunger devices having movable pins that project into and at least partially, preferably halfway, across and into the tail-receiving void. The device is configured such that the spring-loaded pin plunger devices extend at an angle substantially parallel to the movement of the tail-receiving void at the point the pin tips enter therein. The distal end of the second elongate member has an opening through which a multi-wire electrical cable extends. The second elongate member also has a channel in alignment with the opening that has therein the multiple wires of the electrical cable.

15 Claims, 6 Drawing Sheets

ELECTRICAL CONNECTOR FOR AN IN-BODY MULTI-CONTACT MEDICAL ELECTRODE DEVICE

FIELD OF THE INVENTION

This invention is related generally to electrical connectors for use in the medical field and, more particularly, to medical connectors for implantable multi-contact medical electrode devices.

BACKGROUND OF THE INVENTION

Multi-contact medical electrode devices are placed in the human body for various purposes, such as brain-mapping in epilepsy treatment. In such treatments wires generally extend from the multi-contact medical electrode to a plural-contact tail. The plural-contact tail is linear in shape and contains an array of sleeve-like contacts spaced therealong. The plural contacts of the plural-contact tail are to facilitate quick electrical connection of the contacts of the multi-contact medical electrode device such as for monitoring, recording and analysis purposes. Connectors have been configured to simultaneously engage the contacts of the plural-contact tail for their individual electrical connection to separate wire strands which emerge from the connector.

Various connectors have been developed to facilitate plural-contact connection. Examples of such prior art plural-contact medical connectors are those disclosed in the following United States patents: U.S. Pat. No. 4,850,359 (Putz). U.S. Pat. No. 4,869,255 (Putz), U.S. Pat. No. 6,415,168 (Putz), U.S. Pat. No. 4,744,371 (Harris), U.S. Pat. No. 5,560,358 (Arnold et al.). U.S. Pat. No. 5,902,236 (Iversen), U.S. Pat. No. 4,516,820 (Kuzma). U.S. Pat. No. 4,712,557 (Harris), U.S. Pat. No. 4,461,304 (Kuperstein), U.S. Pat. No. 4,379,462 (Borkan et al.), U.S. Pat. No. 4,633,889 (Talalla et al.) and U.S. Pat. No. 4,676,258 (Inokuchi et al.).

Some medical connectors of the prior art have a number of shortcomings. One concern in a surgical setting that involves much equipment, many wires and hoses and the like, is that the connector be small in size to facilitate easy operation by medical personnel. It would be advantageous to have a connector which is small and slim so that it can be easily maneuvered by medical personnel during surgery. A slim design is particularly advantageous with respect to connectors that have a great number of contacts. Some connectors in the prior art are large in size and clumsy making them difficult to organize and manage. Certain prior art connectors utilized a flat ribbon-type cable that emerged laterally off the top of the connector giving the connector a bulky appearance. Other prior art connectors had a build-up of epoxy along the top of the connector that also added bulk.

When using a medical connector it is important that a constant and reliable electrical connection be present so that accurate information can be obtained. Some connectors in the prior art may create concerns with reliability of the connection. A reliable electrical connection is also of paramount importance since often the connectors are in use for lengthy periods of time. If a connector fails during use all of the information obtained may be lost or rendered inaccurate.

Medical connectors for use in patients who have a seizure tendency must also be secure. If a patient has a seizure there is the chance that the electrical connections could be destroyed or disrupted. Specifically, the plural-contact tails of multi-contact electrodes can become dislodged or broken by the involuntary movements that occur during a seizure.

Therefore, it is important that the connector be secure so that it can withstand the jerking motions that are characteristic of seizures.

It would be also highly desirable to have a connector with an improved reliable contact between contacts of the plural-contact tail and the conductors of the connector device. This would ensure good electrical connections despite dimensional variations on the contacts of the tail.

In certain prior art devices the electrical connector is a connector of the type that includes a tail-receiving first elongate member having proximal and distal ends and a second elongate member with corresponding proximal and distal ends. The first elongate member has a presentation face which extends along the second elongate member and the first elongate member also includes a tail-receiving void. The second elongate member has a nesting surface and an array of electrical conductors. The nesting surface includes two faces set at right angles to one another; a pivot-axis-adjacent face and a pivot-axis-opposite face. The first elongate member has a lead edge. When the device is fully closed the lead edge is at the intersection of the pivot-axis-opposite face and the pivot-axis-adjacent face.

In certain prior art devices the electrical conductors along the second elongate member are spring-loaded ball plunger devices which are used to facilitate electrical contact with the plural contacts of the plural-contact tail. The spring-loaded ball plunger device has a plunger axis along which the ball has slight movement. In these devices electrical connection for each contact occurs by the ball riding across the contact of the plural-contact tail until it reaches its final position. In such prior art devices the plungers are positioned along the pivot-axis-opposite face so that engagement occurs when the tail-receiving void is moving in a direction approaching perpendicular to the axis of the spring-loaded ball plunger devices.

The spring-loaded ball plunger devices of the prior art have disadvantages. Most notably the ball on the plunger device does not have the ability to travel as far into the tail-receiving void. This directly effects the ability of the ball to contact the tail receiving void possibly leading to an inaccurate contact. The very nature of the movement of the ball across the contact of the plural-contact tail means there is potential for an inaccurate and unreliable contact.

In summary, there are a number of problems and shortcomings in prior connectors for use with multi-contact medical electrode devices.

OBJECTS OF THE INVENTION

It is an object of this invention to provide a connector for multi-contact medical electrode devices overcoming some of the problems and shortcomings associated with the prior art.

Another object is to provide a multi-contact medical connector which has a streamlined design that facilitates easy operation by medical personnel.

Another object is to provide a multi-contact medical connector which gives highly reliable and constant electrical connections.

Another object of the invention is to provide a multi-contact medical connector which is secure given the involuntary jerking motions which are customary to a seizure condition.

Still another object is to provide improved electrical contacts between contacts of the plural-contact tail and the conductors of the connector device.

These and other objects of the invention will be apparent from the following descriptions and from the drawings.

SUMMARY OF THE INVENTION

This invention is an electrical connector for an in-body multi-contact medical electrode device which is used in combination with a linear-array plural-contact tail.

The multi-contact medical connector of this invention is a connector of the type that includes a tail-receiving first elongate member having proximal and distal ends and a second elongate member with corresponding proximal and distal ends. The first elongate member has a presentation face which extends along the second elongate member and the first elongate member also includes a tail-receiving void. The second elongate member has a nesting surface and an array of electrical conductors. The nesting surface includes two faces set at right angles to one another; a pivot-axis-adjacent face and a pivot-axis-opposite face.

In the invention, the distal end of the second elongate member has an opening through which a multi-wire electrical cable extends to allow connection to remote equipment. The second elongate member has a channel portion in alignment with the opening and has therein multiple wires of the electrical cable each wire is attached to its respective conductor; the wires and attachments are sealed by a body of epoxy-like substance within the channel.

Also in the invention, the second elongate member has a pair of outside surfaces which define intersecting planes and the body of epoxy-like substance is entirely between the second elongate member and the intersecting planes, thereby minimizing the cross-sectional profile of the connector. The distal end of the second elongate member encircles the opening, which allows passage therethrough of the multi-wire electrical cable.

In preferred embodiments the second elongate member includes a pair of opposed endwalls between which the first elongate member extends in nested fashion with its ends adjacent to the endwalls and is pivotable with respect thereto about a pivot axis.

In preferred embodiments, the first elongate member includes a grip flange which facilitates pivoting of the first elongate member from the closed to the open position. The grip flange provides a thumb-grip surface. The second elongate member has at least one lock tab which is positioned so that it overlaps the first elongate member, thereby securing the closed position.

Particularly of significant importance in the invention, the electrical conductors on the second elongate member are spring-loaded pin plunger devices. The spring-loaded pin plunger devices have movable pins projecting into and at least partially, preferably halfway, across and into the tail-receiving void of the first elongate member. The spring-loaded pin plunger devices on the second elongate member extend from the nesting surface at an angle substantially parallel to the movement of the tail-receiving void at the point the pin tips enter therein.

In highly preferred embodiments, the nesting surface includes a pivot-axis-adjacent face and a pivot-axis-opposite face substantially perpendicular thereto. The presentation face is substantially parallel to the pivot-axis-opposite face when the first elongate member is in the closed position.

In certain preferred embodiments, the pin plunger devices protrude beyond the nesting surface toward the first elongate member. The presentation face and the nesting surface abut one another to define the closed position. The presentation face has a lead edge which is adjacent to the nesting surface when the first elongate member is in the closed position. The notches on the presentation face extend to the lead edge such that the first elongate member has lateral openings receiving the pin plunger devices as the first elongate member is pivoted to the closed position.

In highly preferred embodiments, the presentation face and a nesting surface abut one another to define the closed position. At the closed position the first elongate member positions the electrode tail such that the spring-loaded pin plunger devices contact the plural contacts of the tail, thereby providing reliable electrical contact.

The medical connector of this invention has significant advantages over connectors of the prior art. The connector is streamlined in design so that it minimizes the space in which the opening and closing movement occurs. The connector provides excellent electrical connections and is secure. The connector also has improved electrical contacts between contacts of the plural-contact tail and the conductors of the connector device.

The invention includes the medical connector as described above, and also includes the combination of the connector with the linear-array plural-contact tail of a multi-contact medical electrode device.

BRIEF DESCRIPTION OF THE DRAWINGS

The drawings illustrate a preferred embodiment including the above-noted characteristics and features of the invention. The invention will be readily understood from the descriptions and drawings. In the drawings.

DETAILED DESCRIPTION OF PREFERRED EMBODIMENTS

Figure 1:
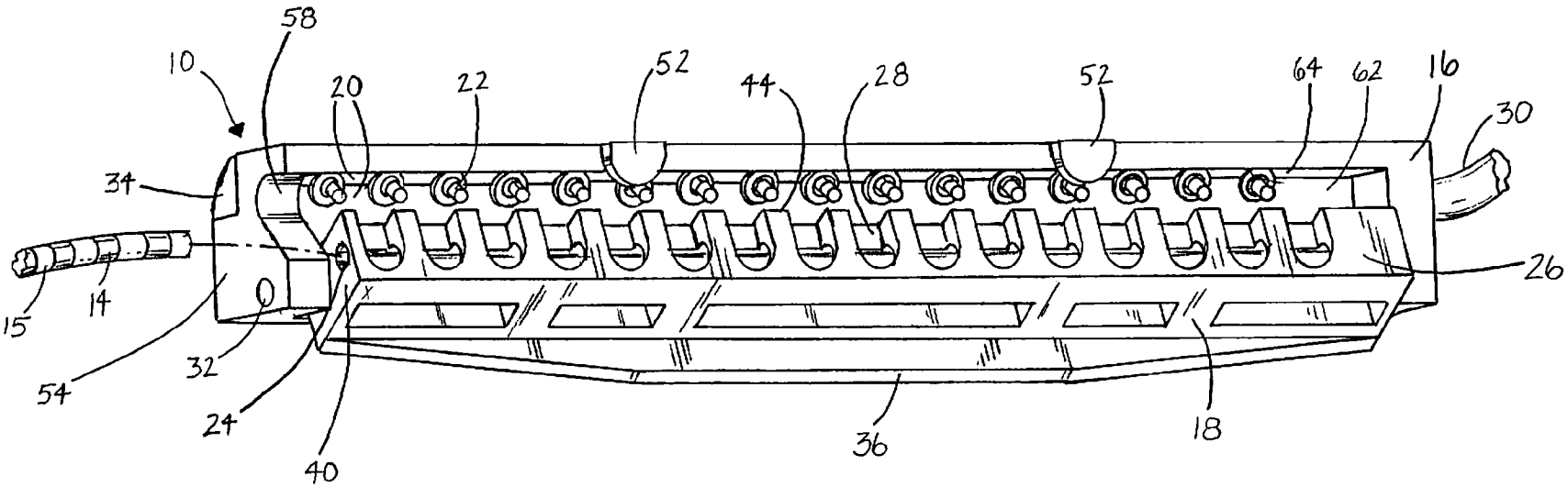
FIG. 1 is a perspective view of the connector in an open position, with the plural-contact tail of an in-body medical electrode in position for insertion into the connector.

FIGS. 1-6 illustrate an electrical connector 10 for connecting the linear-array plural-contact tail 12 of an in-body multi-contact medical electrode (the in-body portion of which is not shown), having a linear array of electrical contacts 14 spaced therealong, each electrically linked by a small electrical wire running up and beyond tail 12 to a particular in-body contact on the in-body portion of the electrode. Connector 10 includes first and second elongate members 18 and 16 which are pivotable with respect to one another about a pivot axis A which extends along their lengths.

Second elongate member 16 has a nesting surface 20 which includes two faces set at right angles to one another, a pivot-axis-adjacent face 62 and a pivot-axis-opposite face 64. A linear array of spring-loaded pin plunger devices 22 are situated along the nesting surface 20 at the intersection of the pivot-axis-adjacent face 62 and pivot-axis-opposite face 64 and extend at an angle substantially parallel to the movement of the tail-receiving void 24 corresponding with the linear array of electrical contacts 14 of plural-contact tail 12.

First elongate member 18 extends along the length of second elongate member 16 and includes a linear tail-receiving void 24, a presentation face 26 which is parallel with and closely adjacent to void 24, and notches 28 along presentation face 26. The notches 28 intersect with void 24 to expose contacts 14 of tail 12 at presentation face 26 in alignment with and intersecting, the pin 23 of spring-loaded pin plunger devices 22.

Figure 2:
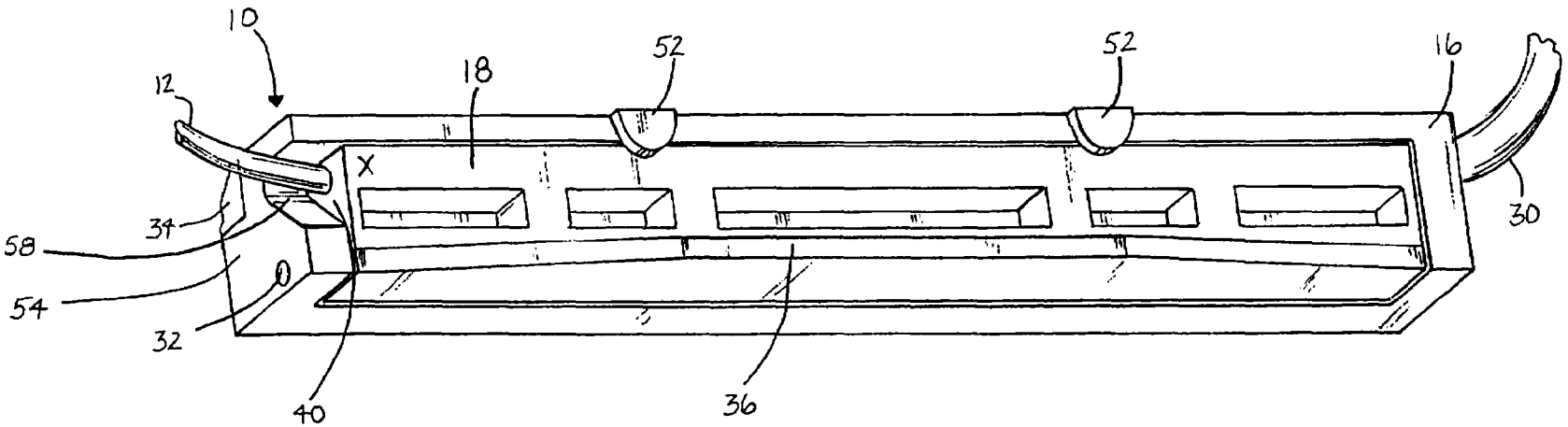
FIG. 2 is a perspective view of the connector of FIG. 1, but with the connector in the closed position.
Figure 3:
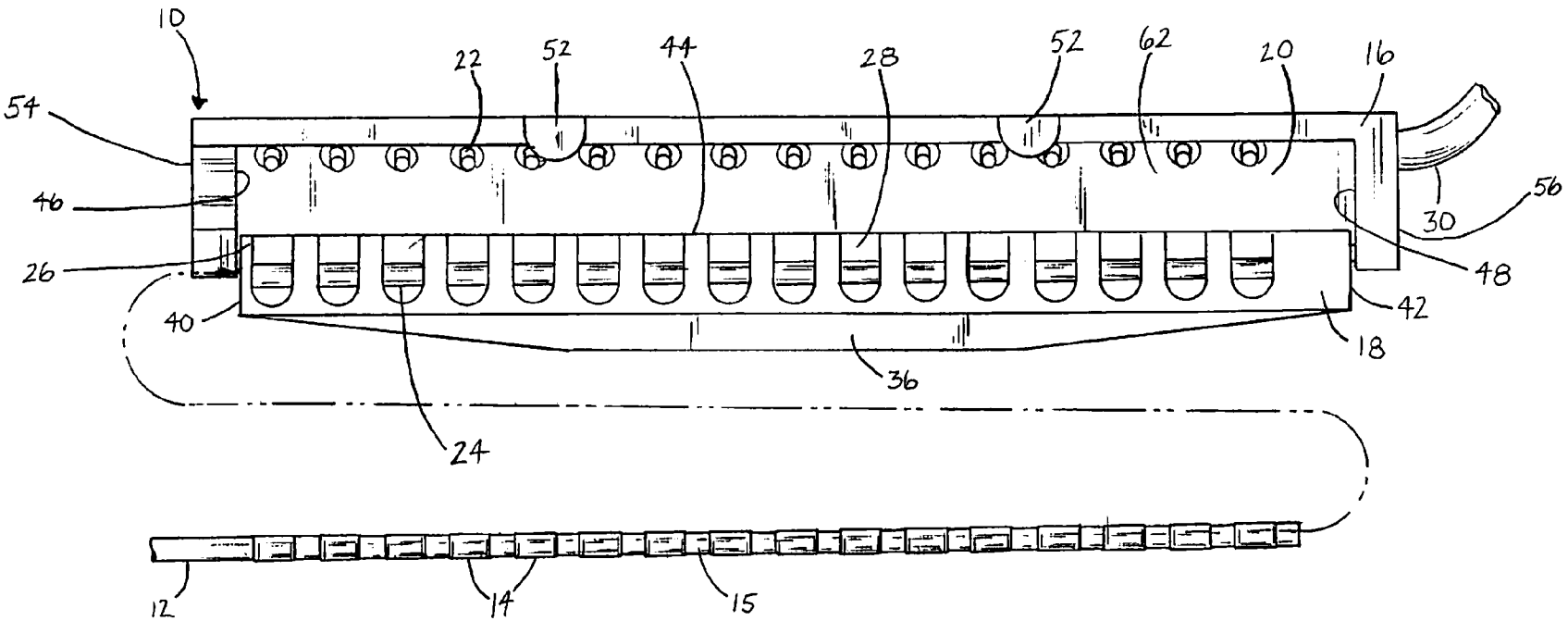
FIG. 3 is a front elevation of the connector of FIG. 1.
Figure 4:
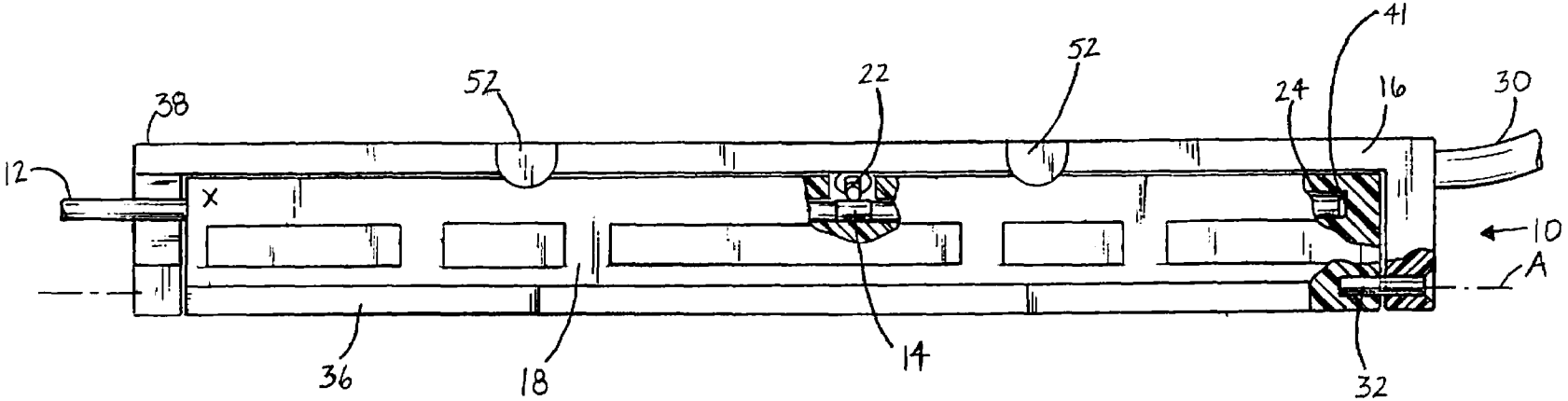
FIG. 4 is a front elevation of the connector of FIG. 2 but with cutaway portions to illustrate certain internal details.
Figure 5:
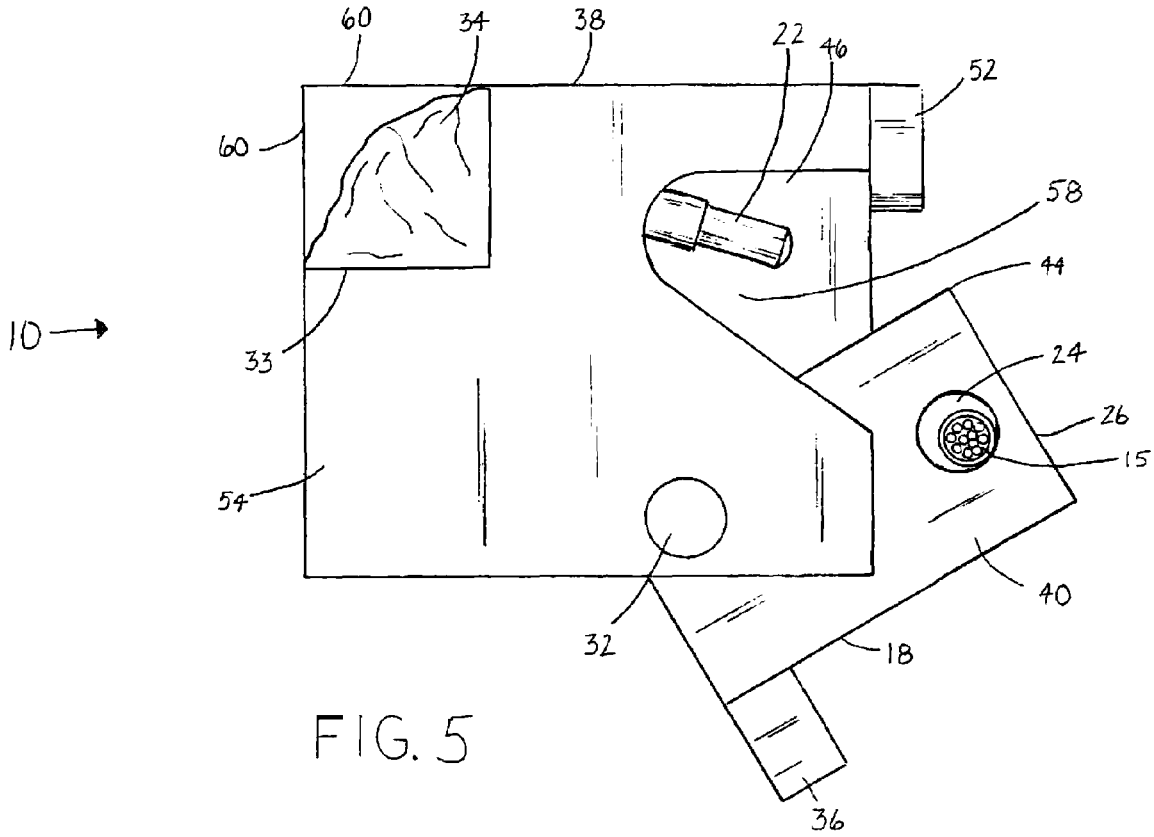
FIG. 5 is a left side elevation of the connector, with the tail inserted, showing the connector just before it is closed.
Figure 6:
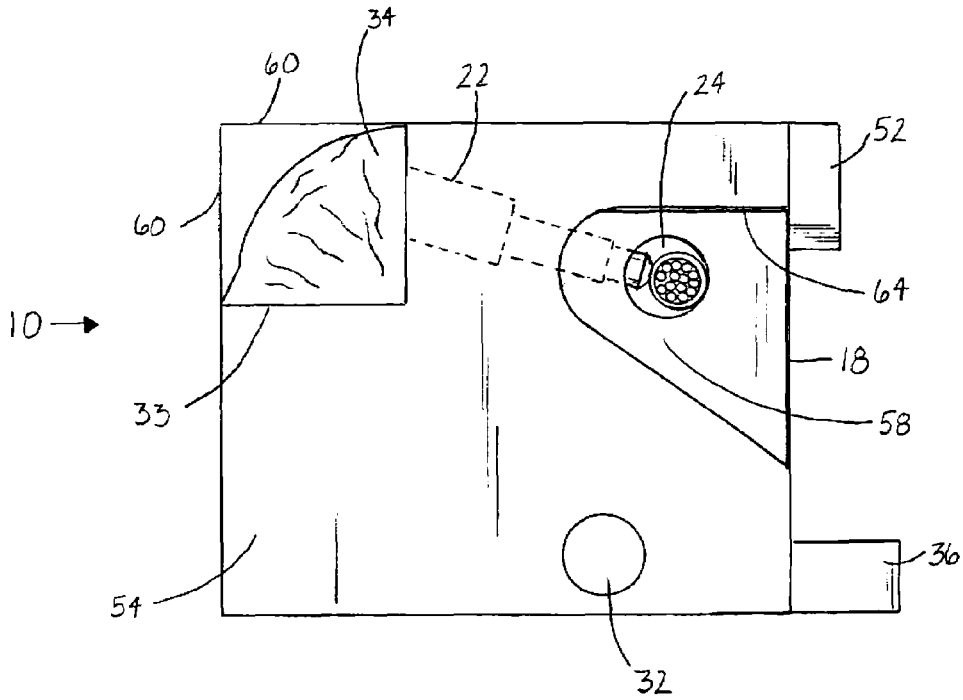
FIG. 6 is a left side elevation of the connector of FIG. 5, but with the connector fully closed.

First elongate member 18 pivots with respect to second elongate member 16 between an open position illustrated by FIGS. 1, 3 and 5 and a closed position illustrated by FIGS. 2, 4 and 6. Pivot pins 32 (see cutaway portion of FIG. 4) extend along axis A and pivotably connect first elongate member 18 with second elongate member 16. In the closed position, presentation face 26 is juxtaposed to nesting surface 20, such that contacts 14 are placed into engagement with spring-loaded pin plunger devices 22, each plunger device 22 is electrically connected to one of the wires which make-up the multi-wire electrical cable 30 which extends from the distal end 56 of the second elongate member 16 and which allows easy connection by means not shown with other equipment.

Second elongate member 16 has an array of spring-loaded pin plunger devices 22 along its nesting surface 20. The spring-loaded pin plunger devices 22 are situated therealong nesting surface 20 and extend at an angle substantially parallel to the movement of the tail-receiving void 24 at the point the pin 23 on the spring-loaded pin plunger device 22 enters therein to facilitate electrical engagement with plural contacts 14 on tail 12. The spring-loaded pin plunger devices 22 extend through second elongate member 16 to allow electrical connection with wires 30. Spring-loaded pin plunger devices 22 are potted in their positions and protrude beyond nesting surface 20 (see cutaway portion of FIG. 4). The wires which make-Lip the multi-wire electrical cable 30 extend into channel 33 filled with an epoxy-like substance 34.

First elongate member 18 has proximal and distal ends 40 and 42, and linear void 24 extends from an opening at proximal end 40 to a stop 41 near distal end 42. The position of stop 41 is fixed such that full insertion of tail 12 into void 24 causes contacts 14 to be in alignment with notches 28 along presentation face 26 of first elongate member 18. Second elongate member 16 includes a pair of opposed inwardly-facing endwalls 46 and 48 between which first elongate member 18 extends in nested fashion, with ends 40 and 42 adjacent to endwalls 46 and 48, respectively. As shown in FIGS. 5 and 6, endwall 46, which is adjacent to proximal end 40 of first elongate member 18, is formed with an electrode tail access area 58 to accommodate the presence of electrode tail 12 during pivoting movement of first elongate member 18.

First elongate member 18 includes an integrally-formed grip flange 36 (see FIGS. 5 and 6), which extends away from pivot axis A. To open connector 10, downward thumb pressure is applied on grip flange 36 to pivot first elongate member 18 away from the closed position shown in FIG. 6.

As shown best in FIG. 3, presentation face 26 has a lead edge 44. Notches 28 are located on lead edge 44 of presentation face 26. This provides a lateral opening to each notch 28 to receive spring-loaded pin plunger devices 22 as first elongate member 18 is pivoted to the closed position.

Figure 7:
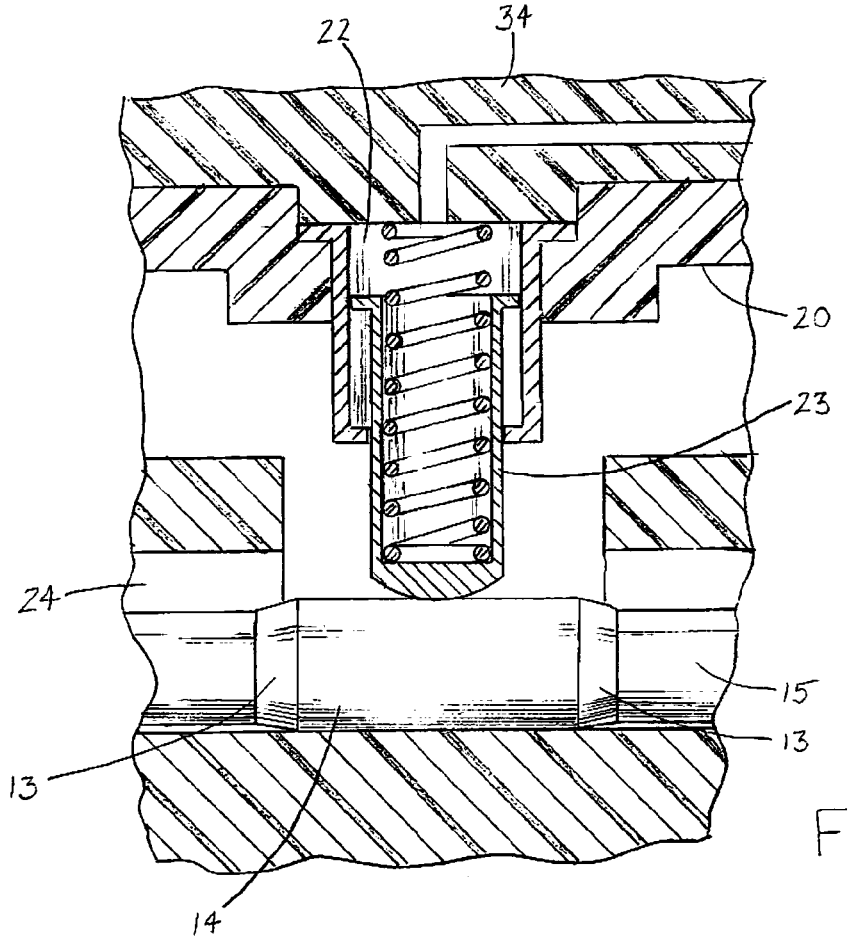
FIG. 7 is an enlarged fragmentary cutaway view of a portion of the connector of FIG. 4, as indicated in FIG. 4.

FIG. 7 illustrates details of contacts 12 and their relationship to pin 23 portion of spring-loaded pin plunger devices 22. Each contact 14 of plural-contact tail 12 is an annular sleeve which includes necked-in ends 13, formed by crimping. As can be seen, the outer diameter of contact sleeves 14 are slightly greater than the outer diameter of the adjacent support tube 15 along which contacts 14 are mounted.

Figure 8:
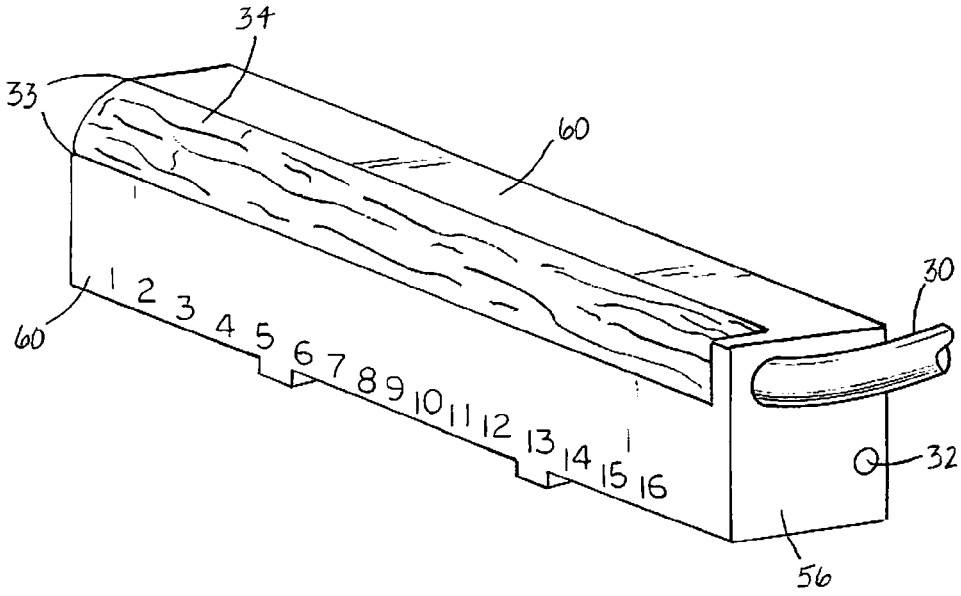
FIG. 8 is a back perspective view of the connector, with the channel and the body of epoxy-like substance.

FIG. 8 illustrates channel 33, where the wires from the multi-wire electrical cable 30 are embedded, is filled with an epoxy-like substance 34 which is contained entirely between the second elongate member 16 and the intersecting planes 60.

First and second elongate members 18 and 16 of medical connector 10 may be made of hard plastic materials, a wide choice of which is available and will be apparent to those receiving this disclosure. First elongate member 18 is preferably made of translucent or transparent material so that the positions of contacts 14 can be seen even without looking at the notches 28. A wide variety of materials is available for the various parts discussed and illustrated herein.

While the principles of this invention have been described in connection with specific embodiments, it should be understood clearly that these descriptions are made only by way of example and are not intended to limit the scope of the invention.

The invention claimed is:

1. In an electrical connector for connecting the linear-array plural-contact tail of an in-body multi-contact medical electrode device, including (a) a tail-receiving first elongate member having proximal and distal ends, the first elongate member forming a tail-receiving void and having a presentation face parallel to the void and having notches therealong intersecting with the void to expose the plural tail contacts and (b) a second elongate member with corresponding proximal and distal ends and having a nesting surface and an array of electrical conductors therealong, the improvement wherein:

the electrical conductors are spring-loaded pin plunger devices having movable pins projecting into and at least partially across and into the tail-receiving void of the first elongate member;

the second elongate member includes a pair of opposed endwalls between which the first elongate member extends in nested fashion with its ends adjacent to the endwalls and is pivotable with respect thereto about a pivot axis; and the spring-loaded pin plunger devices on the second elongate member extend from the nesting surface at an angle substantially parallel to the movement of the tail-receiving void at the point the pin tips enter therein.

2. The multi-contact medical connector of claim 1 wherein the moveable pins project at least halfway across and into the tail-receiving void of the first elongate member.

3. The multi-contact medical connector of claim 1 wherein:

the pin plungers protrude beyond the nesting surface toward the first elongate member;

the presentation face and the nesting surface abut one another to define the closed position;

the presentation face has a lead edge which is adjacent to the nesting surface when the first elongate member is in the closed position; and the notches on the presentation face extend to the lead edge such that the notches receive the pin plunger devices as the first elongate member is pivoted to the closed position.

4. The multi-contact medical connector of claim 1 wherein:

the nesting surface includes a pivot-axis-adjacent face and a pivot-axis-opposite face substantially perpendicular thereto; and the presentation face is substantially parallel to the pivot-axis-opposite face when the first elongate member is in the closed position.

5. In an electrical connector for connecting the linear-array plural-contact tail of an in-body multi-contact medical electrode device, including (a) a tail-receiving first elongate member with proximal and distal ends and a presentation face and (b) a second elongate member with corresponding proximal and distal ends having a nesting surface and, an array of electrical conductors therealong, the proximal end of the second elongate member forming an electrode-tail access area, the first elongate member forming a tail-receiving void, the improvement comprising:

the distal end of the second elongate member having an opening through which a multi-wire electrical cable extends to allow connection to remote equipment;

a channel along the second elongate member in alignment with the opening and having therein the multiple wires of the electrical cable each attached with a respective conductor, the wires and attachments sealed by a body of epoxy-like substance within the channel;

the electrical conductors are spring-loaded pin plunger devices having movable pins projecting into and at least partially across and into the tail-receiving void of the first elongate member;

the second elongate member includes a pair of opposed endwalls between which the first elongate member having proximal and distal ends extends in nested fashion with its ends adjacent to the endwalls and is pivotable with respect thereto about a pivot axis; and the spring-loaded pin plunger devices on the second elongate member extend from the nesting surface at an angle substantially parallel to the movement of the tail-receiving void at the point the pin tips enter therein.

6. The multi-contact medical connector of claim 5 wherein the second elongate member has a pair of outside surfaces defining intersecting planes and the body of epoxy-like substance is entirely between the second elongate member and the intersecting planes, thereby minimizing the cross-sectional profile of the connector.

7. The medical connector of claim 5 wherein the distal end of the second elongate member encircles the opening, which allows passage therethrough of the multi-wire electrical cable.

8. The medical connector of claim 5 where the second elongate member has at least one lock tab positioned to overlap the first elongate member, thereby securing the closed position.

9. In combination, (a) an electrical connector comprising a tail-receiving first elongate member with an presentation face and an elongate tail-receiving void with the plural-contact tail received therein, the first elongate member also having a lead edge with notches therealong intersecting with the void to expose the plural tail contacts, and a second elongate member having a nesting surface and an array of spring-loaded pin plunger devices therealong and (b) a linear-array plural-contact tail inserted within the void, the improvement comprising:

the distal end of the second elongate member having an opening through which a multi-wire electrical cable extends to allow connection to remote equipment;

a channel along the second elongate member in alignment with the opening and having therein the multiple wires of the electrical cable each attached with a respective conductor, the wires and attachments sealed by a body of epoxy-like substance within the channel;

the second elongate member includes a pair of opposed endwalls between which the first elongate member having proximal and distal ends extends in nested fashion with its ends adjacent to the endwalls and is pivotable with respect thereto about a pivot axis; and the spring-loaded pin plunger devices on the second elongate member extend from the nesting surface at an angle substantially parallel to the movement of the tail-receiving void at the point the pin tips enter therein.

10. The multi-contact medical connector of claim 9 wherein the second elongate member has a pair of outside surfaces defining intersecting planes and the body of epoxy-like substance is entirely between the second elongate member and the intersecting planes, thereby minimizing the cross-sectional profile of the connector.

11. The medical connector of claim 9 where the second elongate member has a proximal and distal end, the distal end encircles the opening, which allows passage therethrough of the multi-wire electrical cable.

12. The multi-contact medical connector of claim 9 wherein the presentation face and nesting surface abut one another to define the closed position and the first elongate member includes a grip flange facilitating pivoting of the first elongate member from the closed to the open position.

13. The medical connector of claim 9 wherein the second elongate member has at least one lock tab positioned to overlap the first elongate member, thereby securing the closed position.

14. The multi-contact medical connector of claim 9 wherein:

the pin plungers protrude beyond the nesting surface toward the first elongate member;

the presentation face has a lead edge which is adjacent to the nesting surface when the first elongate member is in the closed position; and the notches on the presentation face extend to the lead edge such that the notches receive the pin plunger devices as the first elongate member is pivoted to the closed position.

15. The multi-contact medical connector of claim 9 wherein:

the nesting surface includes a pivot-axis-adjacent face and a pivot-axis-opposite face substantially perpendicular thereto; and the presentation face is substantially parallel to the pivot-axis-opposite face when the first elongate member is in the closed position.

* * * * *